United States Patent [19]

Schick et al.

[11] Patent Number: 4,756,435

[45] Date of Patent: Jul. 12, 1988

[54] CHILD-PROOF SCREW CLOSURE WITH THREAD STRIPPING PREVENTION

[75] Inventors: Juergen Schick, Hemsbach; Bernd Kaschewski, Erpolzheim; Kurt Ehrenfried, Ludwigshafen, all of Fed. Rep. of Germany

[73] Assignee: Joh. A. Benckiser GmbH, Ludwigshafen, Fed. Rep. of Germany

[21] Appl. No.: 87,600

[22] Filed: Aug. 20, 1987

[30] Foreign Application Priority Data

Aug. 28, 1986 [DE] Fed. Rep. of Germany ..... 3629289

[51] Int. Cl.[4] ..... B65D 55/02

[52] U.S. Cl. ..... 215/216; 222/153

[58] Field of Search ..... 215/216, 217, 218; 222/153, 521

[56] References Cited

U.S. PATENT DOCUMENTS

| | | | |
|---|---|---|---|
| 4,117,945 | 10/1978 | Mumford | 215/216 |
| 4,358,031 | 11/1982 | Lohrman | 215/216 |
| 4,376,497 | 3/1983 | Mumford | 215/216 |

*Primary Examiner*—George T. Hall

*Attorney, Agent, or Firm*—Foley & Lardner, Schwartz, Jeffery, Schwaab, Mack, Blumenthal & Evans

[57] ABSTRACT

The present invention provides a non-strippable, child-proof screw closure for containers, and especially for storage bottles containing cleaning liquids, comprising a pourer arranged on the container having external threads and radially extending stops formed thereon, and a screw cap with catches which can be opened out by the stops. The screw cap has a separate internal threaded piece.

13 Claims, 2 Drawing Sheets

CHILD-PROOF SCREW CLOSURE WITH THREAD STRIPPING PREVENTION

BACKGROUND OF THE INVENTION

The present invention relates to a non-strippable, child-proof screw closure. The childproof screw closure is used for storage containers for domestic chemicals and the like, and especially for bottles containing cleaning liquids. The closure is equally useful for other containers, such as, for example, ones containing medicaments.

Closures for bottles containing cleaning liquids are opened by pressing together oppositely disposed screw cap parts while simultaneously turning the closure in a counterclockwise manner. Stripping of the threads of these closures upon closing is prevented by an appropriately strong dimensioning of the thread, and the child-proofing is accomplished by providing radially distributed catches on the bottle corresponding to stops of the screw cap, with the stops lying therebehind in a closed state. The screw is thereby constructed in two parts, the periphery being the actual cap (carrying the stops) which can be elastically deformed manually, and the inside being a concentric threaded part.

Because the thread must, of necessity, be strongly constructed and because of the undercutting thereby caused, such bottles are produced by a blowing process.

SUMMARY OF THE INVENTION

Therefore, it is an object of the present invention to provide a screw closure of the above-mentioned kind which, with simultaneous improvement of the functional safety, can be produced by an injection molding process.

In accomplishing the foregoing objects, there has been provided according to the present invention a child-proof screw closure for a container which resists stripping, comprising a plate for covering an open end of the container, the plate having a projection comprising threads and defining an aperture which communicates with the interior of the container and having at least one radially disposed raised crosspiece, the raised crosspiece terminating at its radially outermost point in an outer edge; and a cap for closing the plate aperture having a threaded portion threadable with the plate projection to secure the cap to the plate and having at least one radially directed resilient catch for engagement with the crosspiece, the threaded portion having at least one shoulder at its base, whereby, when the cap is threaded to the plate, the resilient catch deforms radially outward as it contacts the outer edge of the crosspiece of the plate, snaps back to its original shape as it moves past the crosspiece and abuttingly contacts the crosspiece to prevent a child from unscrewing the cap from the plate, and whereby the shoulder of the cap abuts the crosspiece when the cap is fully threaded on the projection to prevent further turning of the cap which would strip its threads.

In a preferred embodiment, the invention further comprises a closure including a projection which is a pourer having a double external thread, a cap having a corresponding double internal thread wherein the pitch of each thread spans an angle less than or equal to 180° and the threads are substantially non-overlapping.

Further objects, features and advantages of the present invention will become apparent from the detailed description of preferred embodiments which follows, when considered together with the attached figures of drawing.

BRIEF DESCRIPTION OF THE DRAWINGS

The present invention will now be described in more detail with reference to the accompanying drawings, in which.

DETAILED DESCRIPTION OF THE PREFERRED EMBODIMENTS

Figure 1:
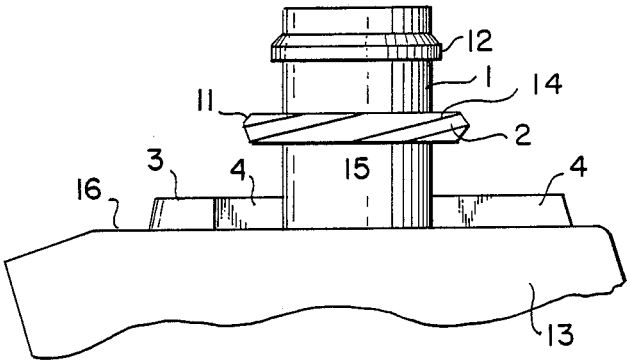
FIG. 1 is a side view of the lower part of the closure present on the container.

Thus, according to the present invention, there is provided a non-strippable, child-proof screw closure for containers and especially for storage bottles containing cleaning liquids, comprising a pourer arranged on the container having external threads and radially extending stops formed thereon. The closure further comprises a screw cap having a separate internal threaded piece and catches which can be opened out by the stops. The pourer has a double external thread, each pitch of the thread spanning an angle of less than or equal to 180°, and the pitches do not overlap or only overlap insubstantially. Additionally, the crosspieces are arranged between the radially extending stops and the pourer, the screw cap has a corresponding double thread on the inner threaded piece, and the inner threaded piece has, to prevent stripping, oppositely disposed wedge-shaped notches which form stop edges that lie against the crosspieces when the cap is completely threaded with the pourer.

The separate internal threaded piece is preferably a cylindrical part with an internal thread. The outer cap cover is formed on the top side of the internal threaded piece in such a manner that it can be resiliently pressed together, for distorting the shape of the cover to free the catches located behind the stops when it is desired to remove the cap from the container.

In accordance with the invention, a closure can be produced which is free of undercutting and can thus be produced by an injection molding process.

Due to the formation of a double thread with, in each case, a looping angle of less than or equal to 180°, two thread half pitches are formed on the pourer with the upper edge of one half pitch running out over the upper edge of the other lower thread half pitch. Such a thread can be produced without undercutting but is limited to relatively small pitch depths and thus is not non-strippable.

Therefore, according to the present invention, the stripping prevention feature of the thread is separate from its screw function and is designed as a stop-edge crosspiece pair. The start of the threads and the pitches thereof are such that the stop edges come to rest on the crosspieces in the case of a fully screwed closure, the cap thereby normally lying on the vessel top.

For the thread, a pitch depth of about 0.5 mm. has proved to be useful since sufficient stability, operability, and functional removability from the mold used for the production are thereby provided.

Because of its material properties, polypropylene has proved to be very satisfactory for production in an injection molding process. Closures according to the present invention produced therefrom grip precisely, engage in a child-proof manner even after frequent use and have elasticity characteristics and manual force opening requirements which remain constant. Wear impairment of the functional safety, especially wear on the edges of the material, has not been observed.

If, in order to save material, the stop edges of the wedge-shaped notches are to narrow and thus are sharp-edged, stop edges with reinforcing pieces can be provided in order to protect the crosspieces.

Advantageously, the thread on the pourer is on a ring provided thereon. The thread surface can thereby be enlarged while the ring simultaneously serves as a stop for a pushed-on spray nozzle or the like which is secured, for example, by a spring closure.

For crosspieces and stops, a height of about 2 mm and, for the crosspieces, a breadth of at least about 1 mm have proved to be useful, but the dimensions can readily be increased with regard to the particular material conditions.

A smaller dimensioning can, in the case of a relatively hard and resistant polypropylene, also result in disturbances of the functional safety.

The closure is preferably made of the same material as the upper part of the vessel. The upper part of the vessel, which is made by injection molding connected with its lower part, for example, by push fitting, welding or adhering.

FIG. 1 shows a pourer 1 to be closed by a cap, the pourer being arranged on a storage container 13. This pourer has a ring 11 into which are formed two half pitches of an external thread 2 which are entirely or substantially non-overlapping, i.e., the upper edge 14 of the thread half pitch shown on the right begins below the lower edge 15 of the thread half pitch shown on the left. Stops 3 and crosspieces 4 are provided on a plate or top surface 16 of the storage container 13, which carries the pourer 1. The rear sides of the crosspieces extend to the rear sides of the stops 3.

Above the ring 11 which carries the double thread 2 is an impact ring 12. A spray nozzle can be pushed over this and, with the help of the impact ring 12 and an appropriate counterpiece, secured in the nozzle and prevented from slipping through downwardly by means of the ring 11.

Figure 2:
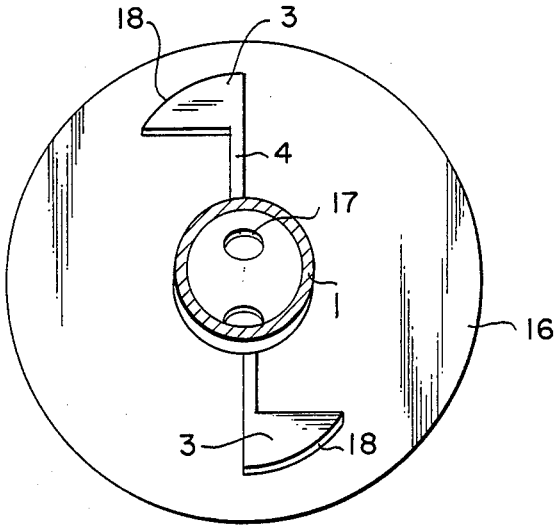
FIG. 2 is a perspective view of the lower part of the closure.

FIG. 2 shows a perspective view of the above-described upper part of a storage vessel. In the pourer 1, there is an opening 17 through which the liquid contents can be removed from the container. On the pourer 1 are oppositely-disposed crosspieces 4 which extend to the stops 3. When the cap is screwed on, spreading wedges 19 of the cap press against the arc- or wedge-shaped front surfaces 18 of the stops 3, (see FIGS. 2, 3 and 4) and move over the stops 3 to lock against their rear flanks, thereby preventing opening by children.

Figure 3:
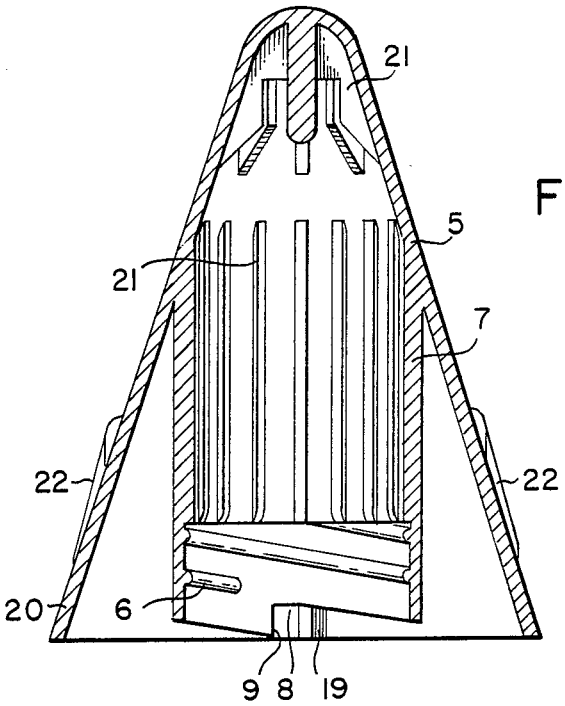
FIG. 3 is a vertical cross-sectional view of the closure cap.

FIG. 3 shows the screw cap 5 for the storage vessle. This comprises an outer cover 20, which is the actual cap, and a separate inner threaded piece 7 connected at the top thereof with the cover 20. Within the cover 20 are spreading wedges 19, one of which can be seen in FIG. 3.

The cover 20 and the inner threaded piece 7 are joined together in such a manner that the cover 20 is sufficiently elastic for closing and opening. For stabilization, the screw cap is provided with ribs 21 and, on the outside of the cover 20, gripping depressions 22 displaced at angle of 90° to the spreading wedges 19 are provided to prevent squeezing the cap at an incorrect angle when opening is attempted.

On the lower part of the inner threaded piece 7 is a corresponding double internal thread 6. The inner threaded piece has oppositely disposed wedge-shaped notches 8 which form the stop edges 9. Stop edges 9 press against the crosspieces 4 and prevent stripping of the thread when the cap is screwed on. The angle between the securing rear edges of the spreading wedges 19 and the stop edges 9 corresponds to the projected breadth of the crosspieces 4.

Figure 4:
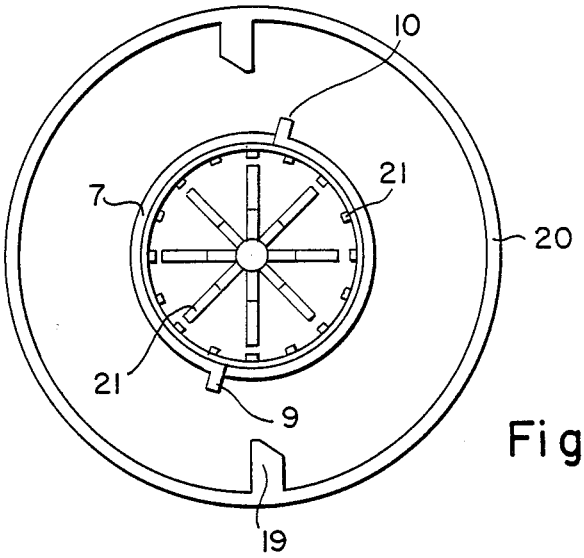
FIG. 4 is a bottom plan view of the closure cap.

FIG. 4 shows a plan view of the bottom of the cap. On the cover 20 are the spreading wedges 19, the distance between which can be increased by applying force on the cover in the direction normal to the diameter connecting the two spreading wedges 19.

The inner threaded piece 7 terminates at the stop edges 9 which are reinforced by thin sheet 10. In the upper part of the closure cap and on the inner surface of the inner threaded piece are provided ribs 21.

What is claimed is:

1. A child-proof screw closure for a container which resists stripping, comprising:

a plate for covering an open end of the container, the plate having a projection comprising threads and defining an aperture which communicates with the interior of the container, said plate having at least one radially disposed raised crosspiece terminating at its radially outermost point in an outer edge; and a cap for closing the aperture, said cap having a threaded portion threadable with the plate projection to secure the cap to the plate and having at least one radially directed resilient catch for engagement with the crosspiece, the threaded portion having at least one shoulder at its base, whereby when the cap is threaded to the plate, the resilient catch deforms radially outward as it contacts the outer edge of the crosspiece of the plate, snaps back to its original shape as it moves past the crosspiece and abuttingly contacts the crosspiece to prevent unscrewing of the cap from the plate, and whereby the shoulder of the cap abuts the crosspiece when the cap is fully threaded on the projection to prevent further turning of the cap which would strip its threads.

2. A closure as claimed in claim 1, wherein the projection of the plate comprises a pourer.

3. A closure as claimed in claim 1, wherein the projection of the plate has a double external thread and the threaded portion of the cap has a corresponding double internal thread.

4. A closure as claimed in claim 3, wherein the pitch of each thread spans an angle less than or equal to 180 degrees and the pitches are substantially non-overlapping.

5. A closure as claimed in claim 3, wherein the depth of each thread is about 0.5 mm.

6. A closure as claimed in claim 1, wherein the closure is produced by an injection molding process.

7. A closure as claimed in claim 1, wherein the closure comprises polypropylene.

8. A closure as claimed in claim 1, wherein the shoulder of the cap projection is provided with a reinforcing projection.

9. A closure as claimed in claim 1, wherein the plate projection is provided with a means for engaging a spray nozzle.

10. A closure as claimed in claim 1, wherein the plate further comprises a second crosspiece colinear with, and oppositely radially directed to the first crosspiece.

11. A closure as claimed in claim 10, wherein the crosspieces have a height of about 2 mm and each crosspiece has a width of about 1 mm.

12. A closure as claimed in claim 1, wherein the cap further comprises a second shoulder disposed diametrically opposite the first shoulder.

13. A closure as claimed in claim 1, wherein the projection is a pourer and has a double external thread, the pitch of each thread spans an angle less than or equal to 180° and the threads are substantially non-overlapping, and wherein the cap has a double internal thread.

* * * * *